US008276404B2

(12) United States Patent
Heggelund et al.

(10) Patent No.: US 8,276,404 B2
(45) Date of Patent: Oct. 2, 2012

(54) DEVICE FOR AN INSTALLATION OF FORMATION OF FIBRES MATTRESS

(75) Inventors: Johan Heggelund, Spydeberg (NO); Renaud Roquigny, Lausanne (CH); Oleg Boulanov, Nogent sur Oise (FR)

(73) Assignees: Saint-Gobain Isover, Courbevoie (FR); Glava A/S, Askim (NO)

( * ) Notice: Subject to any disclaimer, the term of this patent is extended or adjusted under 35 U.S.C. 154(b) by 272 days.

(21) Appl. No.: 12/670,145

(22) PCT Filed: Jul. 25, 2008

(86) PCT No.: PCT/FR2008/051411

§ 371 (c)(1), (2), (4) Date: Jan. 22, 2010

(87) PCT Pub. No.: WO2009/016324

PCT Pub. Date: Feb. 5, 2009

(65) Prior Publication Data

US 2010/0218560 A1 Sep. 2, 2010

(30) Foreign Application Priority Data

Jul. 26, 2007 (FR) ..... 07 56746

(51) Int. Cl.
*C03B 37/05* (2006.01)

(52) U.S. Cl. ..... 65/516; 65/469; 65/524; 65/526

(58) Field of Classification Search ..... 65/469, 65/516, 524, 526
See application file for complete search history.

(56) References Cited

U.S. PATENT DOCUMENTS

| | | | | |
|---|---|---|---|---|
| 4,300,931 | A | 11/1981 | Phillips | |
| 8,056,369 | B2 * | 11/2011 | Decrocq et al. | 65/454 |

FOREIGN PATENT DOCUMENTS

| | | |
|---|---|---|
| EP | 1 369 393 | 12/2003 |
| JP | 58 79836 | 5/1983 |
| WO | 81 03017 | 10/1981 |
| WO | 2006 061545 | 6/2006 |

* cited by examiner

*Primary Examiner* — Quennie Dehghan
(74) *Attorney, Agent, or Firm* — Oblon, Spivak, McClelland, Maier & Neustadt, L.L.P.

(57) ABSTRACT

A device for installation for forming fiber mats, the fibers being formed from a material that can be drawn by internal centrifuging and by drawing by a gas current. The device includes a guide duct into which the fibers are designed to be channelled, with a longitudinal axis including a first portion configured to form the entrance of the duct at which the fibers are designed to be inserted into the duct, a second portion or central portion, and a third portion configured to form an exit of the duct, and an articulation mechanism to act mechanically on the third portion of the duct to cause its dimension and/or the position of at least one of its portions to vary relative to the longitudinal axis.

17 Claims, 4 Drawing Sheets

DEVICE FOR AN INSTALLATION OF FORMATION OF FIBRES MATTRESS

The invention relates to the formation of fibre mats such as those intended for heat and sound insulation, and relates more particularly to a device for improving the distribution of the fibres that are collected on the receiving member.

The formation of fibres, particularly mineral fibres such as glass fibres, results from a fibre-drawing method consisting in the drawing of the material, such as glass, by centrifuging and by the action of high temperature gas currents.

The fibre-drawing method commonly used today is the method called internal centrifuging. It consists in inserting a thread of the drawable material in the melted state into a centrifuge, again called a fibre spinner, rotating at high speed and pierced on its periphery with a very large number of orifices through which the material is thrown in the form of filaments under the effect of the centrifugal force. By means of an annular burner, these filaments are then subjected to the action of an annular gas current for drawing at high temperature and speed following the wall of the centrifuge which reduces their diameter and transforms them into fibres.

Furthermore, the drawing gas current is usually confined, by means of an enveloping cold gas layer channelling it appropriately in the form of a tubular flow. This gas layer is produced by a blowing crown surrounding the annular burner. It also makes it possible to help the cooling of the fibres whose mechanical strength is thereby improved in all probability by a heat tempering effect.

It is also common to add an annular inductor beneath the centrifuging device in order to help maintain the thermal balance of the spinner. This inductor makes it possible to heat the bottom of the peripheral band of the spinner which is heated less by the drawing gases because it is further from the annular burner, and which is subjected to cooling by the ambient air.

The fibres formed are driven by the drawing gas current towards a receiving belt usually consisting of a gas-permeable band on which the fibres mingle in the form of a mat.

To fix the fibres together, a binder is usually sprayed onto the fibres during their journey to the receiving belt. The spraying of the binder is for example carried out with the aid of a sizing crown which surrounds the gas current and which comprises a plurality of spraying orifices.

The binder is then hardened for example by a heat treatment beyond the receiving belt.

One of the difficulties encountered in preparing these mats relates to the distribution of the fibres in the whole mat which is desired to be as uniform as possible. An unevenness in the distribution in the mat may result in a local density that is less than the desired density, which is usually corrected in manufacture by increasing the average density of the mat. It is always desirable to reduce the density of a product to make it less heavy and obtain insulation, particularly heat insulation, performance every bit as good. There is therefore a continual search on the production line to make the best job of evening up the distribution of the fibres in the mat.

A known means for improving the distribution of the fibres is the use of a device called the "bucket" as is described in patent application FR 2 544 754, which consists of a guide duct placed on the path of the gas current beneath the centrifuge and above the binder-spraying device. This duct makes it possible to channel the fibres; it is driven in an oscillating motion in order to direct the flow of fibres alternately from one side to the other of the belt receiving the fibres.

However, this oscillating motion with a substantially sharp return to each amplitude, on the one hand, does not appear optimum with respect to the driving of the fibres in the air current, and on the other hand, increases the friction of the fibres against the walls of the device, which tends to damage its mechanical properties.

Another known means consists in blowing air towards the tubular gas flow, in a substantially perpendicular manner in order to traverse it.

Patent FR 1 244 530 therefore describes two nozzles that are arranged beyond the binder spraying device and diametrically opposed to the gas flow, and whose air jets are actuated in turn in order to impress on the stream of fibres a back-and-forth motion when it is placed on the reception belt.

Patent U.S. Pat. No. 4,266,960 shows two devices that each supply a flat air jet arriving at great speed perpendicularly and into the tubular gas flow, the two devices being placed on either side of the gas flow so that the orientation of the air jets separates the tubular flow into several divergent flows.

These various blowing means by compressed air therefore force the air to be directed in a manner substantially perpendicular to the tubular stream of fibres in order to divide the tubular flow and/or change its orientation.

The object of the invention is to provide a device for the manufacture of fibre mats for the purpose of improving the distribution of the fibres in a mat, particularly by retaining the required quality of the fibres at the exit from drawing, this device not having the disadvantages of the prior art, in particular of the "bucket" device, and making it possible to obtain uniform mats of the desired density for the purpose of a given thermal or insulating performance.

According to the invention, the device, more particularly designed for an installation for forming fibre mats, the fibres being formed from a material that can be drawn by internal centrifuging and by drawing by means of a gas current, comprises a guide duct into which the fibres are designed to be channelled, with a longitudinal axis (X) and which has a first portion designed to form the entrance of the duct at which the fibres are designed to be inserted into the said duct, a second portion or central portion and a third portion designed to form the exit of the said duct, the device being characterized in that it comprises articulation means that are suitable for acting mechanically on the third portion of the duct so as to cause its dimension and/or the position of at least one of its portions to vary relative to the said longitudinal axis (X).

The dimension of the third portion of the duct that is capable of varying usually and preferably corresponds to its cross section (along a plane perpendicular to the longitudinal axis X). This section is usually circular, but may equally be elliptical, or have any other shape.

The device therefore makes it possible, by modifying the exit section of the guide duct to promote and adapt the expansion of the stream of fibres in order to finally manage the distribution of the fibres in the mat. The dimension of the exit section is in particular adapted according to the diameter of the centrifuging device, the height of the fall of the fibres from the centrifuging device to the receiving belt, and the number of centrifuging devices situated above the receiving belt, so that, depending on the width of the belt, the fibres are distributed over the whole width of the belt and do not stick to the hood walls of the installation that border the belt.

In addition, this device, which is designed to remain essentially fixed within a fibre-spinning installation, is therefore simpler to use and allows better accessibility to the other elements comprising the fibre-spinning installation in comparison with a standard "bucket" device which oscillates during fibre-spinning. In particular it has the following advantages:

there is no need to set an amplitude of oscillation, the cleaning of the sizing crown during fibre spinning is made easier, the distribution of the binder is obtained in a more even manner on a falling stream in a substantially fixed and unmoving direction because of oscillations;

the friction of the fibres against the walls is definitely reduced.

The third portion of the duct of the device according to the invention is usually movable, at least partially, in particular so that its dimensions can vary. This third portion may also be movable, totally or partially, relative to the longitudinal axis, for example in a plane substantially perpendicular to this axis.

Since the device of the invention which provides a more uniform distribution of the fibres in a mat makes it possible to reduce the density of this mat, the product is therefore less heavy and less expensive to produce while retaining the same insulation properties. The reduction of the density also makes it possible, for one and the same throughput of the drawable melted material, to increase the quantity of mat produced.

To supply the change of section of the exit of the guide duct, the third portion of the duct may have the shape of a flexible skirt consisting of an extensible membrane. The changing of the dimensions of the skirt may for example result from an inflation or from any other mechanical actions. The skirt may for example take the shape of a torus or more generally of any volume generated by the rotation of any shape about an axis situated in its plane. The insertion of air into the torus makes it possible to inflate the structure, thereby changing the exit section of the guide duct.

To provide the change of section of the exit of the guide duct, the third portion of the duct consists preferably of a plurality of side panels arranged so as to form a solid wall, the articulation means being capable of acting concomitantly on the mobility of the side panels relative to the axis (X).

Each side panel preferably has two opposite lateral edges of which one overlaps the lateral edge of the adjacent side panel, and the mobility of the side panels consists in a pivoting of the side panels towards or away from the axis X, the overlapping of the side panels allowing one side panel to slide against another in order to ensure that they incline together. The motion made by the side panels to increase or reduce the exit section of the duct may be assimilated respectively to the opening or closing of the petals of a flower corolla. Alternatively, the side panels may be disjointed, that is to say not overlap.

According to one feature, the side panels are inclined by a maximum of 10°, and preferably by a maximum of 7°, relative to the axis (X) and in a divergent direction relative to the axis (X).

The side panels may also be inclined by a maximum of 10°, and preferably by a maximum of 7°, relative to the axis (X) and in a convergent manner towards the axis (X).

The degree of inclination and the convergence or divergence of the exit of the duct relative to the axis X will be adapted to adjust the expansion of the stream of fibres in an appropriate manner.

The articulation means act mechanically on the third portion of the duct so as to cause its dimension to vary, particularly those acting concomitantly on the mobility of the side panels relative to the axis X may be very diverse. Most of the time they will consist in mechanical systems capable of simultaneously applying a pressure to each of the side panels. Each of these mechanical systems may be mechanically and/or electrically and/or hydraulically controlled.

These articulation means may consist in a ring of fixed diameter, whose main plane is perpendicular to the longitudinal axis X, the said ring also being able to be moved in translation, parallel to the said longitudinal axis X, and surrounding the wall formed by the side panels while exerting a compression stress on the latter. This ring that can be moved in translation may advantageously be fixedly attached to the side panels by means of connecting means. In particular, the side panels may be provided with oblong windows arranged longitudinally in which these linking means may slide. The height adjustment of the ring that can be moved in translation makes it possible to adjust the degree of inclination of the side panels. The ring may also contribute to a modification of the position of the third portion of the duct relative to the longitudinal axis: by a movement of the ring in its plane, it is possible to impress upon the side panels a general movement which may contribute to optimizing the distribution of the fibres in the mat.

The articulation means may also consist in a ring surrounding the wall formed by the side panels while exerting a stress on the latter, the diameter of the ring being variable. In this case, it is simpler to provide a ring whose main plane is fixed and perpendicular to the longitudinal axis X. The variable-diameter ring is preferably fixedly attached to the side panels. A contraction of the diameter of the ring is therefore capable of forcing an inclination of the side panels in the direction of the longitudinal axis X, hence an increase in the convergence of the exit of the duct relative to the same axis, while an enlargement of the said diameter on the contrary causes an increase in the divergence of the exit of the duct relative to this axis. Any device making it possible to obtain a variable-diameter ring can be used, such as for example devices of the diaphragm, slip knot or inflatable torus type. In the latter case, a torus (or more generally a volume generated by the rotation of a form about an axis situated in its plane) consisting of a flexible membrane capable of being inflated, may, by inflation, see its internal diameter reduce, thereby creating a stress on the side panels capable of inclining them towards the longitudinal axis.

Preferably, the articulation means consist in a ring that is capable of being moved in rotation and that is connected to the side panels in order to act simultaneously on them, the rotation of the ring being designed to generate a stress that is exerted on a portion of the side panels, the angle of rotation being in relation with the desired angle of inclination of the side panels relative to the axis (X).

Advantageously, the device comprises mechanical actuation means acting on the rotation of the movable ring, these actuation means being controlled manually or slaved by electronic control means.

According to another feature, all the portions of the guide duct form a solid-wall duct, so that no disruptive induced air can penetrate the inside of the device laterally to the stream.

Advantageously, the first portion of the guide duct, opposite to the central portion, has a flared opening shape so as to ease the entry and guidance of the fibres in the duct.

In addition, the first portion of the duct comprises its wall which has, at its free end, preferably a profile with a concavity turned towards the inside of the device. The curvature of the wall may have a fixed or variable radius of curvature, of geometric shape, respectively circular or elliptical, parabolic. This profile allows the ambient air to enter in the best way into the duct by sliding along the inside of the wall of the duct, supplying a guide channel to the fibres and acting as a barrier of protection against the fibres which thereby avoid sticking to the wall.

According to one feature, the side panels of the third portion have, on the inside of the duct, a concave shape in order to help constitute the cylindrical shape of the inside of the duct.

The invention also relates to an installation for forming fibre mats comprising a device for centrifuging a material that can be drawn, particularly glass, which is provided with a fibre spinner delivering filaments of the said material, and a gas drawing device which supplies a gas current at high temperature and which transforms the filaments into fibres in the form of a substantially tubular stream, the installation being characterized in that it comprises a device with a guide duct for improving the distribution of the fibres of the stream as described hereinabove according to the invention.

The installation usually comprises an inductor that is arranged beneath the centrifuging device, the device with a guide duct being placed close to and beneath the inductor.

During operation of the installation, the guide duct preferably has its longitudinal axis (X) fixed relative to the axis (A) of fall of the stream of fibres. But the guide duct may rather have its longitudinal axis (X) parallel to or inclined relative to the axis (A) of fall of the stream of fibres.

Advantageously, the articulation means of the guide duct can be actuated during the operation of the fibre spinning installation in order to correct the distribution of the fibres dynamically.

Advantageously, the guide duct, which comprises side panels extending substantially parallel to the axis of the duct and arranged in a circular and inclinable manner in convergence or in divergence relative to the central axis of the duct and which have their lateral edges such that the edge of one side panel overlaps via the outside the edge of an adjacent side panel, is placed in the installation so that the direction of overlap is directed in the opposite direction of rotation of the centrifuging device, and consequently in the opposite direction of rotation of the stream inside the duct. In this manner, the fibres cannot stick in the gap of overlap of the side panels, because the rotating stream thus follows the inside of the side panels with no risk of insertion just at the gap.

Preferably, in particular when the device with guide duct is placed at least immediately beneath the inductor, it consists of a material that is heat-resistant and does not capture the magnetic field generated by the inductor.

The installation may comprise a binder supply device which is placed downstream of the device for improving the distribution of the fibres.

In addition, a device for blowing air towards the stream, such as an air gun, may be provided positioned beneath the binder supply device; in certain conditions, related in particular to the width of the receiving belt, it makes it possible to further improve the distribution of the fibres in the mat.

The words "upstream" and "downstream" in the rest of the description must be understood as being the highest and respectively lowest portions of an element with regard to a portion of the installation which, put in place for its operation, receives the flow of the material for fibre-spinning from top to bottom. And the words "horizontal" and "vertical" for elements of the guide duct are understood relative to the disposition of the guide duct which extends substantially vertically.

Finally, the invention relates to a method of manufacturing a fibre mat using the device of the invention to improve the distribution of fibres in the mat.

Other advantages and features of the invention will now be described in greater detail with respect to the appended drawings in which.

The representations illustrated in the figures are schematic without being strictly to scale in order to make them easier to read.

Figure 1:
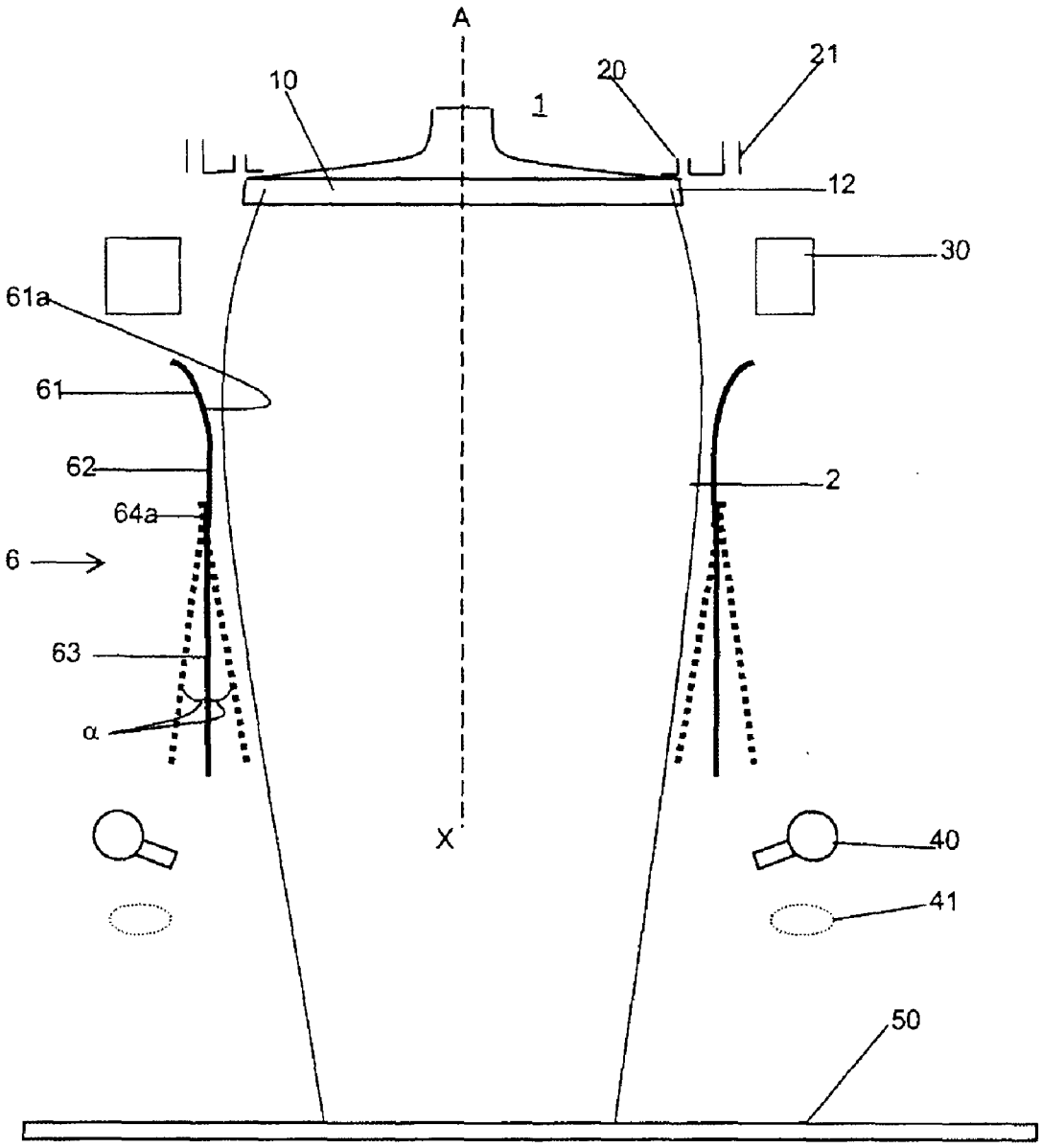
FIG. 1 represents a partial schematic view in section of an installation for forming fibre mats comprising a device for improving the distribution of the fibres according to the invention.

FIG. 1 represents a partial view, in cross section and along a vertical plane, of an installation for forming fibre felts according to the invention.

The installation 1 comprises, in a known manner from upstream to downstream, or from top to bottom, in the direction of flow of the drawable material in the melted state, an internal centrifuging device 10 which delivers filaments of a drawable material, a drawing device 20 delivering a gas current which transforms the filaments into fibres, an annular inductor 30 situated beneath the centrifuging device 10, a binder-supply device 40, a belt 50 for receiving the fibres on which the fibres accumulate by suction in order to form the mat.

According to the invention, the installation also comprises a device 6 for improving the distribution of the fibres on the receiving belt 50. This device is situated between the inductor 30 and the binder-supply device 40.

The centrifuging device 10 comprises a centrifuge, also called a fibre spinner, rotating at high speed and pierced on its peripheral wall by a very large number of orifices through which the melted material is thrown in the form of filaments under the effect of the centrifugal force.

The drawing device 20 comprises an annular burner which delivers a gas current at high temperature and speed following the wall 12 of the centrifuge. This burner is used to maintain the high temperature of the wall of the centrifuge and contributes to thinning the filaments in order to transform them into fibres which fall in the form of a substantially tubular stream 2 with the axis A.

The drawing gas current is usually channelled by means of an enveloping layer of cold gas. This gas layer is produced by a blowing crown 21 surrounding the annular burner. It also makes it possible to help the cooling of the fibres whose mechanical strength is thereby improved by a heat tempering effect.

The annular inductor 30 heats the bottom of the centrifuging device in order to help to maintain the thermal balance of the spinner.

The device 6 for improving the distribution of the fibres comprises a guide duct 60 extending along a longitudinal axis X, which makes it possible to channel the tubular stream passing through the duct, and articulation means 7 capable of changing the exit section of the guide duct 60 in order to promote and regulate the expansion of the stream of fibres at the exit of the duct in order to finally manage the distribution of the fibres. The device will be described in greater detail below. The improvement device 6 is fixed relative to the other devices of the fibre-spinning installation.

The binder-supply device 40 consists of a sizing crown through which the tubular stream of fibres flows. The crown comprises a multiplicity of nozzles spraying the stream of fibres with binder.

The device of the invention 6 may if necessary be associated with a known compressed air blowing system 41, in dashed lines in FIG. 1 such as air guns, which will be positioned beneath the sizing crown 40.

The stream of fibres is then deposited on the receiving belt 50.

Figure 2:
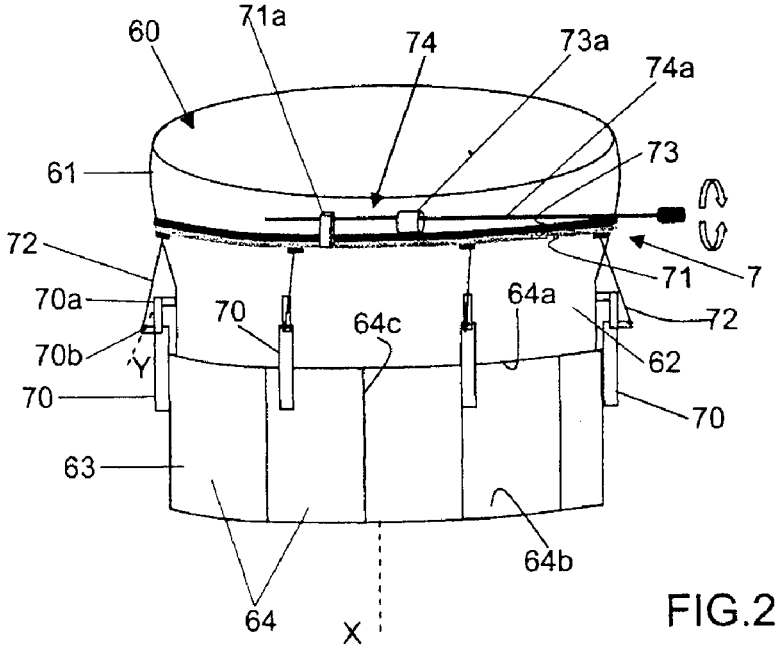
FIG. 2 illustrates a view in profile of one embodiment of the device of the invention.

FIG. 2 shows the device of the invention in greater detail.

The guide duct 60 with a solid wall comprises a first upstream portion 61 designed to form the entrance of the duct for the stream of fibres, a second central portion 62 and a third downstream portion 63 designed to form the exit of the duct for the stream of fibres.

Figure 4:
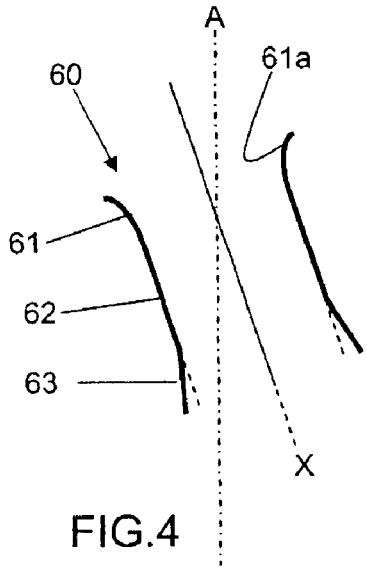
FIG. 4 illustrates a schematic view in vertical and partial section of the device of the invention inserted in a fibre-spinning installation.

The upstream portion 61 has a shape that is flared towards the drawing device in order to make the entrance and the channelling of the stream of fibres into the duct easier. More particularly, the wall 61*a* advantageously has a profile curved toward the inside of the device towards the axis X, whose concavity may have a fixed or variable radius of curvature such as that of a circle or an ellipse (FIG. 4).

The central portion 62 is cylindrical in shape with a longitudinal axis X; it extends in the continuity of the first portion 61 and preferably forms a single piece with the said first portion.

The downstream portion 63 is attached to the central portion 62 in order to ensure a continuity of the duct. According to the invention, the downstream portion 63 has a circular section that is capable of changing.

This section may be made to vary during the operation of the fibre-spinning installation.

Therefore, the duct 60 has a generally tubular shape with a flared neck at one of the free ends and an opposite free end that is either flared, or narrowed, according respectively to the diameter imposed by the downstream portion 63 relative to the diameter of the central portion 62.

The change in diameter of this downstream portion 63 is obtained by the particular configuration of the component elements and by articulation means 7 suitable for acting on the mobility of the component elements.

According to one exemplary embodiment which is in no way limiting, the lower portion 63 consists of a plurality of side panels 64 which extend parallel to the axis X and are arranged in a circular manner, and preferably having a concavity turned towards the inside of the duct in order to easily supply a cylindrical shape to the inside of the duct.

The side panels 64 have an upper portion 64*a*, a lower portion 64*b* and opposite lateral edges 64*c* and 64*d*. The portion 64*a* of the side panels partially covers the central portion 62 of the duct in order to provide continuity of closure over the whole periphery of the duct in order to prevent any penetration of induced air. The lower portion 64*b* corresponds to the exit of the duct 60.

Figure 3:
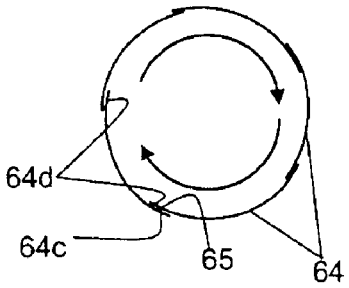
FIG. 3 is a schematic view in section and from below of the device of the invention.

The side panels are superposed on one another so that the lateral edge 64*c* of one side panel overlaps on the outside of the duct the lateral edge 64*d* of the adjacent side panel, as can be seen in FIG. 3 which shows a view in section and from below of the duct at the lower portion 63.

Advantageously, the device is placed in the fibre-spinning installation so that the direction of overlap is in the opposite direction of rotation of the centrifuging device, and consequently in the opposite direction of rotation of the stream inside the duct (symbolized by the arrow inside the duct). In this manner, the fibres of the stream in rotation which therefore follow the inside of the side panels do not risk being inserted at the gap 65 of overlap of the side panels.

The side panels 64 are associated with articulation means 7 which act simultaneously by squeezing the upper portion 64*a* of the side panels in order to make them incline.

As a function of the force applied on the side panels, the inclination relative to the axis X is variable, at an angle $\alpha$ which varies from −10° with a direction that is divergent relative to the axis X, to +10° with a direction that is convergent towards the axis X, the reference 0° corresponding to the parallelism of the side panels with the axis X and the central portion 62.

The articulation means 7 are adjusted so that, when no force is applied to the upper portion 64*a*, the inclination of the side panels is divergent relative to the axis X and is at a maximum angle.

According to a non-limiting embodiment, the articulation means 7, as illustrated in FIG. 2, comprise retaining gusset plates 70, a ring 71 capable of being moved in rotation that is connected to the retaining gusset plates via mechanical connections 72, a fixed ring 73 supporting the movable ring 71, and an actuation system 74 capable of causing the movable ring 71 to slide in rotation relative to the fixed ring.

The retaining gusset plates 70 are attached relative to the side panels 64 and are rendered fixedly attached to them by being, for example, screwed or welded to them.

The gusset plates 70 are used to hold the side panels in position, the gusset plates being supported via mechanical connections 72 by the movable ring 71 which is itself supported by the fixed ring 73.

Each gusset plate is rendered movable by its inclination relative to the central portion 62 of the duct, in order precisely to render each side panel inclinable relative to the central portion 62. Each gusset plate 70 therefore comprises a seat 70*a* welded to the central portion 62 and a pivot 70*b* with an axis Y perpendicular to the axis X, and around which the gusset plate is designed to articulate.

The fixed ring 73 which supports the movable ring allows the movable ring 71 to slide in rotation via a fastener screwing suitable for sliding.

In addition, the fixed ring 73 is used to hold the movable ring 71 in place about the guide duct 60 because it is rendered fixedly attached while surrounding it to the upstream portion 61 of the duct.

The use of a ring to connect in one piece all of the side panels makes it possible to act concomitantly on the side panels.

The mechanical connection 72 of each gusset plate 70 to the movable ring 71 is achieved by a connecting rod extending in a vertical plane and in an inclined manner in this plane (FIG. 2). One of its ends is connected to the ring 71 while its opposite end is connected to the pivot 70*b* of the gusset plate.

The connecting rod reflects the difference in height between the retaining gusset plate placed on the portion 64*a* of the duct and the ring arranged on the portion 61. It is designed to move in a vertical plane and makes it possible to transform the horizontal rotary sliding movement of the ring into a pivoting movement of the retaining gusset plates about each axis Y.

Specifically, the distance between the two ends of the connecting rod remaining constant and the retaining gusset plate being attached both to a side panel and the central portion 62, the rotation of the ring 71 in one direction or in the other necessarily leads to changing the inclination of the connecting rod which will be either more vertical, or will incline more towards the horizontal. The greater the vertical inclination, the greater the strain applied to the retaining gusset plate, and the pivoting of the gusset plate will then be in the anticlockwise direction leading to the inclination of the side panel towards the axis X. On the other hand, the closer the inclination of the connecting rod comes to the horizontal, the greater the relaxation of the strain applied to the gusset plate, causing the gusset plate to pivot in the clockwise direction and leading to the side panel inclining away from the axis X.

Finally, the actuation system 74 acting on the mobility of the ring 71 comprises two attachment points that are respectively positioned on the fixed ring 73 and on the movable ring 71, a nut 73*a* and respectively a nut 71*a* in which a threaded rod 74*a* is engaged. The tightening or loosening of the rod causes the nut 73*a* of the movable ring to slide in rotation relative to the other nut 71*a* which remains fixed, causing the movable ring to slide in rotation in one direction or the other.

The rod may be actuated manually by an operator or else by electronic control means in response to a command communicated by a programmable controller.

Figure 5:
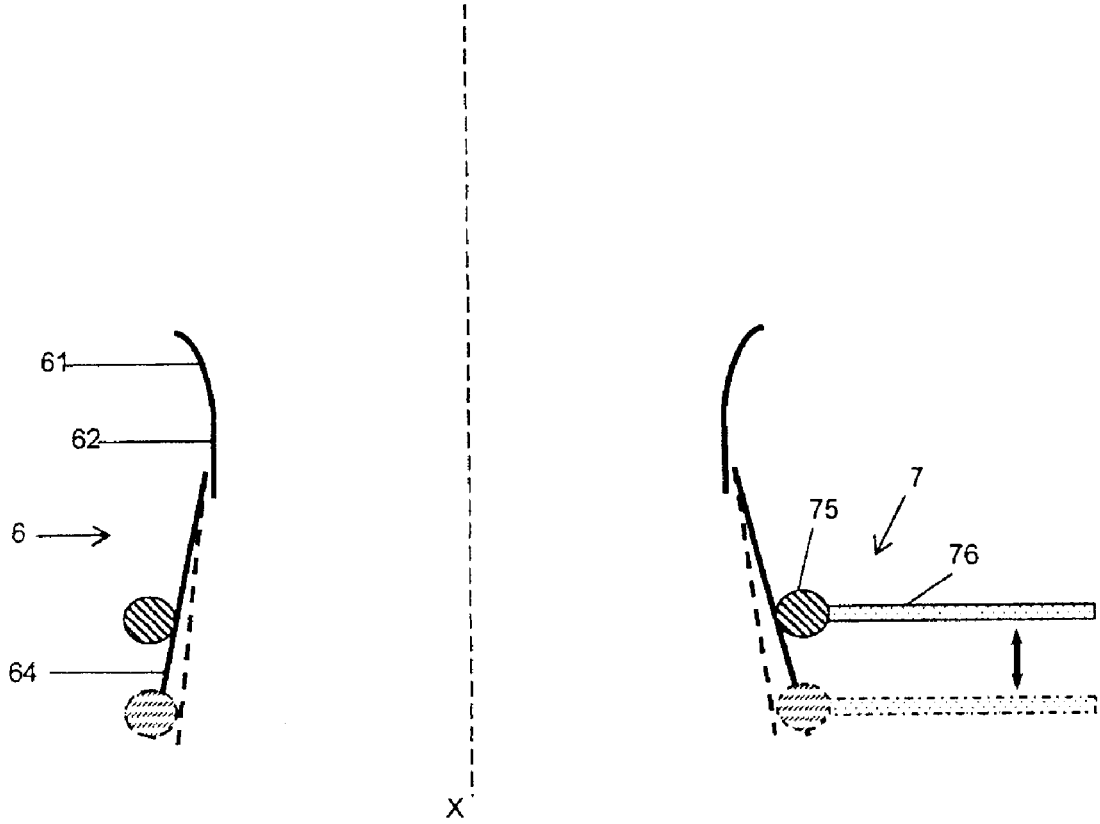
FIG. 5 illustrates a schematic view in section of one embodiment of the device according to the invention.

The articulation means 7, as illustrated in FIG. 5 according to another non-limiting embodiment, consist of a ring 75 of fixed diameter, represented in section, whose main plane is perpendicular to the longitudinal axis X. The ring 75 is movable in translation, parallel to the said longitudinal axis (in the direction of the arrow), thanks to a shaft 76 fixedly attached to the ring 75. The ring 75 surrounds the wall formed by the side panels while exerting a compression stress on the latter. The height-adjustment of the ring 75 makes it possible to adjust the degree of inclination of the side panels. FIG. 5 shows schematically two positions of the ring 75: a first "top" position represented in solid lines, and a second "bottom" position represented in broken lines. In both cases, the side panels 64 are represented also in solid lines if the ring 75 is in the top position, and in broken lines when the ring 75 is in the bottom position. FIG. 5 clearly shows that lowering the ring 75 makes it possible to incline the side panel towards the axis X, and therefore to reduce the divergence of the side panel relative to this axis. It is also possible to move the ring 75 in its plane, therefore in a plane perpendicular to the axis X, in order to impress a movement on the side panels, and therefore on the whole of the third portion of the duct.

The device of the invention has its axis X usually parallel to the axis A for delivering the stream of fibres. However, since the device of the invention is not bonded to the inductor, ambient air turbulence may act on the orientation of the stream entering the device. It may also be appropriate to incline, as a "bucket" device in the prior art, the device of the invention relative to the axis A, as illustrated schematically in FIG. 4, in order to correct the orientation of the stream of fibres because of a lack of right-left uniformity of aspiration of the belt 50.

Figure 6:
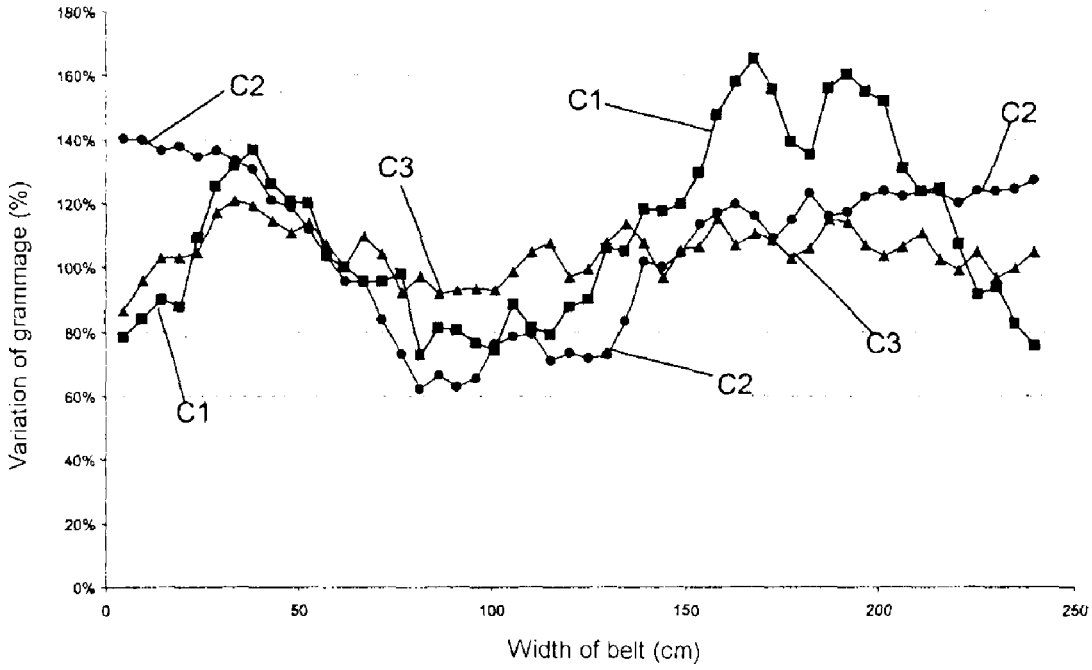
FIG. 6 illustrates the curves on the variation of grammage relative to the nominal grammage of a fibre mat as a function of the width of the receiving belt.

FIG. 6 illustrates three curves relating to the variation (in %) of the surface density of a mat of fibres relative to a nominal reference surface density (in this instance 848 g/m$^2$), as a function of the width of the receiving belt (from 0 cm for the left edge of the belt to 240 cm for the right edge of the belt), the curves corresponding respectively to a reference configuration of a guide duct and to two configuration variants of the device of the invention.

The pilot installation used to test the device of the invention delivers a fibre mat 2400 mm wide. A grammage gauge scans the width of the mat over a given length of the said mat in order to deduce the average weight therefrom. Several estimates of average weight are made and are converted into a grammage value (weight per unit of surface area). The illustrated curves are deduced therefrom.

The average of these average weights and the standard deviation of these measurements were also computed in order to deduce the coefficient of variation of surface density (CV) by the ratio between the standard deviation and the average of the weights.

Measurements on the mat were taken at different angles of inclination of the side panels, with the device being fixed, in a general direction X parallel to the stream delivery axis A:

For the reference curve C1, the angle of inclination of the side panels is 0° relative to the axis X, that is to say that the diameter of the exit 63 of the guide duct corresponds to the diameter of the central portion 62 and the blowing system 41 was used. The coefficient of variation of the computed surface density CV is equal to 25%.

For the curve C2, the angle of inclination of the side panels diverges by 5° relative to the axis X and the blowing system 41 was used in the same conditions as for the curve C1. The coefficient of variation of the computed surface density CV is equal to 23%.

For the curve C3, the angle of inclination of the side panels diverges by 5° relative to the axis X just as for the curve C2, but the blowing system 41 was modified relative to the conditions of the curve C1 or C2, in particular by lowering the pressure of blown air. The coefficient of variation of the computed surface density CV is equal to 7%.

It is noted that, for the curve C1, the stream of fibres dispersed by the blowing system 41 at the exit of the guide duct is not distributed evenly over the width of the belt. The distribution is as follows:

at the two ends of the belt, the fibres are less numerous (a hollow with a variation of up to 80%);

still on the left and right edges of the belt, but moving closer to the centre, there is an excess of fibres (bumps characteristic of the curve going up to 140%, and even 160%);

while the centre of the belt comprises markedly fewer fibres (a recess of approximately 80%).

For the curve C2, the stream of fibres expands at the flared exit of the guide duct (divergence of 5° according to one variant of the invention). It is noted that it was possible to compensate for the lack of fibres at the ends of the belt, the coefficient being well beyond 100% relative to the mentioned recesses of the curve C1, while nevertheless losing fibres in the middle of the belt (coefficient a little lower than for C1). This configuration of the device of the invention nevertheless makes it possible to smooth the distribution of the fibres relative to the reference device relative to the curve C1. In addition, the coefficient of variation of surface density gains at points by going from 25 to 23%.

The reduction in the air pressure blown by the blowing system 41 according to the last configuration relative to the curve C3 makes it possible to further even out the distribution relative to the curve C2, the curve C3 being substantially stable around 100%. In addition, the coefficient of variation of the surface density is even reduced to 7%.

The device of the invention therefore leads to a better distribution of the fibres. In addition, associated with a blowing system of the prior art, such as 41, it causes reduced consumption of compressed air.

The invention claimed is:

1. A device for an installation for forming fiber mats, the fibers being formed from a material that can be drawn by internal centrifuging and by drawing by a gas current, the device comprising:

a guide duct into which the fibers are designed to be channelled, with a longitudinal axis, the guide duct including:

a first portion configured to form an entrance of the duct at which the fibers are designed to be inserted into the duct, a second portion, and a third portion configured to form an exit of the duct; and articulation means for acting mechanically on the third portion of the guide duct so as to cause at least one of a diameter and a position of at least a part of the third portion to vary relative to the longitudinal axis, the articulation means being attached to the second and third portions when a mechanical action of the articulation means causes at least a variation of the position of at least a part of the third portion relative to the longitudinal axis.

2. A device according to claim 1, wherein the third portion includes a plurality of side panels arranged so as to form a wall of the third portion, the articulation means being capable of acting concomitantly on mobility of the side panels relative to the longitudinal axis.

3. A device according to claim 2, wherein each side panel includes two opposite lateral edges of which one overlaps the lateral edge of the adjacent side panel, and the mobility of the side panels includes a pivoting of the side panels towards or away from the longitudinal axis.

4. A device according to claim 3, wherein the said panels are inclined by a maximum of 10°, relative to the longitudinal axis and in a divergent direction relative to the longitudinal axis.

5. A device according to claim 3, wherein the side panels are inclined by a maximum of 10°, relative to the longitudinal axis and in a convergent manner towards the longitudinal axis.

6. A device according to claim 2, wherein the articulation means includes a ring that is capable of being moved in rotation and that is connected to the side panels to act simultaneously on the side panels, the rotation of the ring being designed to generate a stress that is exerted on a portion of the side panels, the angle of rotation being in relation with the desired angle of inclination of the side panels relative to the longitudinal axis.

7. A device according to claim 6, further comprising mechanical actuation means acting on the rotation of the moveable ring, the actuation means being controlled manually or slaved by an electronic control means.

8. A device according to claim 2, wherein the side panels have, on the inside of the duct, a concave shape to constitute a cylindrical shape of the inside of the duct.

9. A device according to claim 1, wherein all portions of the guide duct form a solid-wall duct.

10. A device according to claim 1, wherein the first portion of the duct comprises its wall which has, at its free end, a curved profile with a concavity turned towards the inside of the device.

11. A device according to claim 1, wherein the first portion of the duct, opposite to the central portion, has a flared opening shape.

12. An installation for forming a fiber mat comprising:

a device for centrifuging a material or glass that can be drawn, which includes a fiber spinner delivering filaments of the material;

a gas drawing device which supplies a gas current at high temperature and which transforms the filaments into fibers in a form of a tubular stream; and a device with a guide duct according to claim 1.

13. An installation according to claim 12, wherein an inductor is arranged beneath the centrifuging device, the device with a guide duct being placed immediately beneath the inductor, and including a material that is heat-resistant and does not capture a magnetic field generated by the inductor.

14. An installation according to claim 12, wherein during operation of the installation, the guide duct has its longitudinal axis fixed relative to an axis of fall of the stream of fibers.

15. An installation according to claim 14, wherein the guide duct has its longitudinal axis parallel to or inclined relative to an axis of fall of the stream of fibers.

16. An installation according to claim 12, wherein the articulation means of the guide duct can be actuated during operation of the installation.

17. An installation according to claim 12, wherein the guide duct comprises side panels extending substantially parallel to the central axis of the duct and arranged in a circular manner, the side panels configured to be inclined in convergence or in divergence relative to the central axis of the duct and having their lateral edges such that the edge of one side panel overlaps via the outside the edge of an adjacent side panel, and wherein the duct is placed in the installation so that the direction of overlap of the side panels is directed in the opposite direction of rotation of the centrifuging device.

* * * * *